US006223820B1

(12) United States Patent
Carisella

(10) Patent No.: US 6,223,820 B1
(45) Date of Patent: May 1, 2001

(54) INFLATABLE PACKING DEVICE INCLUDING COVER MEANS FOR EFFECTING A UNIFORM EXPANSION PROFILE

(76) Inventor: James V. Carisella, P.O. Box 10498, New Orleans, LA (US) 70181-0498

( * ) Notice: Subject to any disclaimer, the term of this patent is extended or adjusted under 35 U.S.C. 154(b) by 0 days.

(21) Appl. No.: 09/290,373

(22) Filed: Apr. 12, 1999

(51) Int. Cl.[7] ..... E21B 33/127
(52) U.S. Cl. ..... 166/187; 277/334
(58) Field of Search ..... 166/118, 120, 166/122, 187; 277/331, 334

(56) References Cited

U.S. PATENT DOCUMENTS

| | | | | |
|---|---|---|---|---|
| 4,768,590 | * | 9/1988 | Sanford et al. | 166/187 |
| 4,781,249 | | 11/1988 | Wood . | |
| 4,967,846 | | 11/1990 | Wood . | |
| 4,979,570 | | 12/1990 | Mody . | |
| 5,101,908 | | 4/1992 | Mody . | |
| 5,143,154 | | 9/1992 | Mody . | |
| 5,280,824 | | 1/1994 | Eslinger . | |
| 5,361,836 | | 11/1994 | Sorem . | |
| 5,469,919 | | 11/1995 | Carisella . | |
| 5,507,341 | | 4/1996 | Eslinger . | |
| 5,564,504 | | 10/1996 | Carisella . | |
| 5,605,195 | | 2/1997 | Eslinger . | |
| 5,778,982 | * | 7/1998 | Hauck et al. | 166/387 |
| 5,813,459 | | 9/1998 | Carisella . | |

OTHER PUBLICATIONS

Eslinger, D.M. "Design and Testing of a High–Performance Inflatable Packer"—SPE 37483—Society of Petroleum Engineers—Copyright 1997.

High Pressure Integrity, Inc. Z–44 Element "2 1/8 inch Double Cover Element With Contoured OD Profile" undated.

* cited by examiner

*Primary Examiner*—David Bagnell
*Assistant Examiner*—Zakiya Walker
(74) *Attorney, Agent, or Firm*—Beirne Maynard & Parsons, LLP.

(57) ABSTRACT

An inflatable packing device for use in a subterranean well provides a sophisticated cover means which results in a uniform expansion profile and exceptionally low angles of expansion propagation during inflation of the bladder to set the device, whereby well fluids between the wall of the well bore and the exterior of the cover of the device are swept away from the area of subsequent sealing of the cover. The propensity for rib kinking and rib cutting, pinching, folding, cracking and tearing of the bladder during inflation are eliminated. Correspondingly, reduced stresses and strains in cover segments combined with near ideal inflation profiles result in enhanced expansion propagation of the inflation element and improved service performance and reliability of the downhole device.

18 Claims, 14 Drawing Sheets

Prior Art

INFLATABLE PACKING DEVICE INCLUDING COVER MEANS FOR EFFECTING A UNIFORM EXPANSION PROFILE

BACKGROUND OF THE INVENTION (1) Field of the Invention

The invention relates to an inflatable packing device including a sophisticated elastomeric cover means.

(2) Definitoio of Terms

As used herein and in the claims, the phrase "inflation initiation" refers to the location or point on the exterior of the device where first flexing of the contour of the device resulting from effective inflation is expected to occur. Inflation initiation can occur at a plurality of locations or points, depending upon choice of design.

As used herein and in the claims, the phrase "inflation element" means: the sub-assembly generally composed of the bladder, ribs, cover, upper securing means and lower collars or securing means.

As used herein and in the claims, the phrase "point of contact" means: the initial and subsequently latest expected location of interface between the exterior of the device and the wall of the well during effective inflation.

As used herein and in the claims, the phrase "effective inflation" means: the quantum of expansion of the bladder during the setting of the packing device from the run-in position of the apparatus to from between no more than about 70% to no more than about 85%, by volume, of the interior of the bladder when fully set in the well bore.

As used herein and in the claims, the phrase "departure angle" means: the angle between a straight line parallel to the longitudinal axis of the well and along the inside diameter wall of the well passing through a point of contact and a straight line drawn tangent to the exterior surface of the device for an interval of length extending from the point of contact to a distance of about one run-in diameter, this line too passing through the same point of contact. The longitudinal axis of the borehole and the two lines defining the departure angle must all be coplanar.

As used herein and in the claims, the phrase "expansion profiles" means: the transitional forms taken by the flexible portion of the inflation element during effective inflation.

As used herein, the phrase "uniform inflation profiles" means: the circumstance when the "expansion profiles" taken by the inflation element closely approximate straight line profiles from the point of contact to the end of the collar.

As used herein, the phrase "expansion ratio" means: the ratio of the diameter of the fully set inflation element, divided by the run-in diameter of the inflation element.

(3) Description of the Prior Art

Inflatable packers, bridge plugs, and the like, have long been utilized in subterranean wells. Such inflatable tools normally comprise an inflatable elastomeric bladder element concentrically disposed around a central body portion, such as a tube or mandrel. A sheath of reinforcing slats or ribs is typically provided exteriorally around the bladder with an elastomeric packing cover concentrically disposed around at least a portion of the sheath. Generally, a medial portion of the sheath will be exposed and without a cover for providing anchoring engagement of the packer to the wall of the well. Pressured fluid is communicated from the top of the well or interior of the well bore by means of a down hole pump to the interior of the body and thence through radial passages provided for such purpose or otherwise around the exterior of the body to the interior of the bladder during inflation.

Normally, an upper securing means engages the upper end of the inflatable elastomeric bladder and the reinforcing sheath (if included in the design), sealably securing the upper end of the bladder relative to the body, while a lower collar or securing means engages the lower end of the bladder and reinforcing sheath, securing the lower end of the bladder for slidable and sealable movement relative to the exterior of the body, in response to inflation forces. The elastomeric cover may be secured to the exterior of the sheath or placed around the exterior of the bladder, in known fashion.

With inflatable packers of this type, it has been observed that the portion of the bladder adjacent the exposed sheath section of the packer prematurely inflates prior to the other portions of the bladder which are reinforced against expansion by the reinforcing sheath and/or the elastomeric packing cover element. When the inflation element expands, one end of the bladder moves toward the other end of the device, and the bladder area adjacent the exposed sheath inflates until it meets the wall of the well bore, which may be cased or uncased. If the well bore is uncased, the well bore will have an earthen wall, and if the well bore is cased, the wall of the well bore will be the internal diameter surface of the casing.

It has been noted in a number of prior art designs that when service conditions encompass moderate expansion ratios, a propensity for the bladder to pinch around the exterior of the body arises, creating either a seal or a convoluted fold in the bladder that sometimes prevents the effective communication of further fluid throughout the bladder and preventing contiguous inflation propagation. The pinching seal and/or fold(s) can become entrenched in the bladder whereupon they obstruct further passage of fluid employed for inflating the bladder and therein keep fluid from reaching the farthest portions of bladder to be inflated. When this occurs in service, it always results in a soft set condition and in the imminent loss of seal between the cover and wellbore. This problem is discussed in detail in Eslinger, et al. "Design and Testing of a High-Performance Inflatable Packer," SPE 37483, Society of Petroleum Engineers (1997).

Folds in the bladder can be expected to occur in prior art devices like that shown in FIG. 18 when the expansion ratio is greater than 2:1. Designs of this sort inherently experience large departure angles and unfavorable expansion profiles when the expansion ratio is about 2:1 or more. By utilization of the design of the present invention, the departure angle is preferably controlled at no more than about 15° and the inflation element experiences a uniform inflation profile and therefore, no folds or pinches will occur even if the expansion ratio is 3:1, or even higher. Elimination of the propensity to form folds and pinches in the present invention can be attributed to exceptionally low departure angles throughout inflation and the propagation of uniform inflation profiles throughout effective inflation.

The formation of folds creates unusually high triaxial stresses and strains in the vicinity of the fold. Correspondingly, these triaxial stresses and strains create a condition that causes localized failure of the bladder by means of cracking and/or tearing. Failure occurs because the physical properties of the elastomeric material composing the bladder are not adequate to survive the localized triaxial stresses and strains. Except for the devices described in my patents U.S. Pat. No. 5,469,919, U.S. Pat. No. 5,564,504 and U.S. Pat. No. 5,813,459, all other prior art devices having an element construction similar to that shown in FIG. 18 experience large departure angles and unfavorable expansion profiles when the expansion ratio is greater that 2.00:1, i.e., departure angles greater than 25° at a 2:1 expansion ratio and expansion profiles similar to that shown in FIG. 18. An expansion profile would be deemed unfavorable if the slope of the exterior surface at any point on the inflation element exceeds 15° relative to the longitudinal axis of the wellbore. The term "unfavorable expansion profile" is only applicable to the "effective inflation" portion of the inflation cycle. The propensity to form pinching seals and folds is directly related to undesirable combinations of expansion ratio, departure angles and expansion profiles of the device. In prior art devices, pinching seals and folds are experienced upon the combination of departure angles greater than about 15° and an expansion ratio greater than about 2.25:1.

With regard to covers, at expansion ratios of 2:1 and more, the departure angle in prior art devices other than those for the preferred embodiments in my aforementioned patents will be greater than 20° and the combination of a departure angle greater than 20° and an expansion ratio greater than about 2:1 has been observed to result in cracking and tearing in covers. Once a tear or tears occur, non-uniform rib spacing results. Non-uniform load distribution within the cover also occurs and general discontinuity of the cover results. These conditions, in turn, can result in extrusion of the bladder between ribs resulting in subsequent failure of the bladder and service failure of the device.

In my U.S. Pat. Nos. 5,469,919, 5,564,504, and 5,813,459 entitled "Programmed Shaped Inflatable Packer Device," issued Sep. 29, 1998, I disclose methods to abate the formation of pinching seals and folds during inflation of prior art devices by using a design which includes a series of shaped-controlling means on an elastomeric packing cover along the length of the bladder in the form of high and low modulus modules of varying lengths and thicknesses. While this design is an advancement in the art, the design of the modules leaves comparatively sharp angled transitional chamfers and significant size differences between the high and low modules. These chamfers and different diameters are of such magnitude that they are easily detected by the naked eye. The short transitional chamfers give rise to localized stresses and strains in expanded covers. These localized stresses and strains can cause cracking and/or tearing in the covers which can ultimately result in device failure.

In another prior art device which was subjected to service conditions having expansion ratios of 2.35:1 and 3:1, the minimum achievable departure angles were about 15° and 23°, respectively. This device used a plateau cover interval concept in accordance with my patents U.S. Pat. No. 5,469,919, U.S. Pat. No. 5,564,504 and U.S. Pat. No. 5,813,459 and has been made commercially available by High Pressure Integrity, Inc. under the product name "Z-44". While this product was an advancement and improvement over other prior art devices, the variations of constant thickness cover intervals with abrupt and relatively short transitions from one thickness to another caused comparatively high localized stress and strain concentrators in the cover which occasionally resulted in cracking and tearing of the cover. Z-44 and similar devices always exhibited rib kinking and experienced occasional rib cutting of the bladder. Additionally, inflation profiles exhibited plateau intervals (intervals of constant diameter along the length of the device) rather than relatively straight sloped profiles in the interval between the last point of contact with the casing (POC) and the end of the collar. Additionally, the plateau cover interval concept abated the formation of pinches and folds in bladders at moderate expansion ratios, but did not eliminate their occurrence at expansion ratios greater than 2.35:1.

The ability to successfully deflate and retrieve an inflatable device is a common service requirement. A pinch or fold might still have formed in a bladder during inflation even though the inflation element effected a satisfactory seal against the wall of the well. During deflation, a fold can pinch and seal around the body, obstructing the transmission of fluid out of the lower portions of the bladder and thereby prevent complete deflation of the bladder. Once a fold is formed, it is permanently entrenched in bladder and results in multiple layers of bladder beneath the ribs. These layers in turn result in a deflated diameter which is greater than the initial run-in diameter of the inflation element. Retrieval of the device to the earth's surface is thus compromised since the device might not be able to pass through restrictions in the well bore as it is moved upwardly therein.

I have now discovered that the problems described above can be further abated by providing an inflatable packing device having a combination of an excellent uniform expansion profile during effective inflation and minimal departure angles throughout the inflation cycle. This combination results in contiguous propagation of expansion profiles that are not achievable in any prior art devices.

The invention permits orchestration of varying sophisticated contours and configurations in the cover means to provide a uniform expansion profile in an expected, i.e., pre-determinable, manner which can be achieved with only minimal or nominal experimentation which will be within the ordinary skills of those knowledgeable in the design and use of inflatable elastomeric devices for use in subterranean wells, and by adhering to the teachings herein.

SUMMARY OF THE INVENTION

An inflatable packing device such as a bridge plug, packer, cement retainer, etc., is provided for use in a subterranean well bore. The well bore has a wall which may either be open hole or casing, and the use of the term "wall" or "well bore wall" contemplates either open hole or cased hole. The packing device is carriable into the well bore on a "conveyance mechanism," such as coiled tubing, production or workover tubing, conventional threaded pipe, wireline, electric line, or the like. The device is inflated in known ways by pressured fluid communicated to the device from a source of fluid to cause the packing device to seal against the wall upon inflation.

The packing device includes a housing, preferably having an elongated mandrel extending between each of the ends of the housing. Means are provided on the housing for effective engagement of the housing relative to the conveyance mechanism. Such engagement may either be direct, such as by threads, or may be indirect, by provision of a setting tool which is connected to the conveyance mechanism at one end thereof and to the packing device at the other end thereof. An inflatable elastomeric bladder is included along the housing and concentrically disposed around the mandrel. An elastomeric cover means is positioned exteriorally of the bladder for sealing against the wall of the well bore. The cover means is programmed to permit the cover means to have a continuously smooth outer surface area extending from a point of contact during effective inflation at a departure angle of no more than about 10°, whereby a uniform expansion profile is provided on the cover means to displace well fluids between the wall of the well bore and the exterior of the cover during effective inflation. In such manner, rib kinking and pinching or folding of the bladder around the mandrel is abated during such inflation. The resulting uniform continuous smooth outer surface on the cover is provided by means of orchestrated variation in the original thickness of the cover component during manufacture.

The design of the packing device may provide for a single cover means extending from approximate one end of the housing to the other approximate other end thereof. The packing device may also be provided in a design in which plural cover sections are provided along the length of the housing with a series of circumferentially extending expandable metallic slats being exposed directly to the well bore between such cover sections for anchoring the packing device during setting. The invention also contemplates a packing device having a design wherein there are plural points of initial contact with the continuously smooth contour configuration of the cover means extending toward each end of the housing.

The configuration of the invention eliminates any sharp changes in the cover thickness, such as "stepped" variances which are so dramatic that they are readily identifiable, both visually and by feel. All thicknesses in the cover are intentionally graduated over comparatively long intervals, resulting in the elimination of stress and strain concentrations in the cover means related to changes in thickness and the assurance of continuous, contiguous/homogeneous sealing contact of the cover means to the well wall. Such contours reduce the propensity to initiate tears in the cover, as opposed to some prior art devices which merely attempt to arrest the propagation of a tear in the cover via abrupt changes in cover thickness.

The ability of the device of the present invention to prevent tearing in the cover is a direct result of the combination of very low departure angles and the reduction of stress and strain concentrations in the cover. These features are achieved by providing continuous interengagement of variations in the thickness of the cover without sharp or abrupt angular changes between such contours during effective inflation of the device by adhering to the low departure angle concept of the present invention.

DESCRIPTION OF THE PREFERRED EMBODIMENTS

Figure 18:
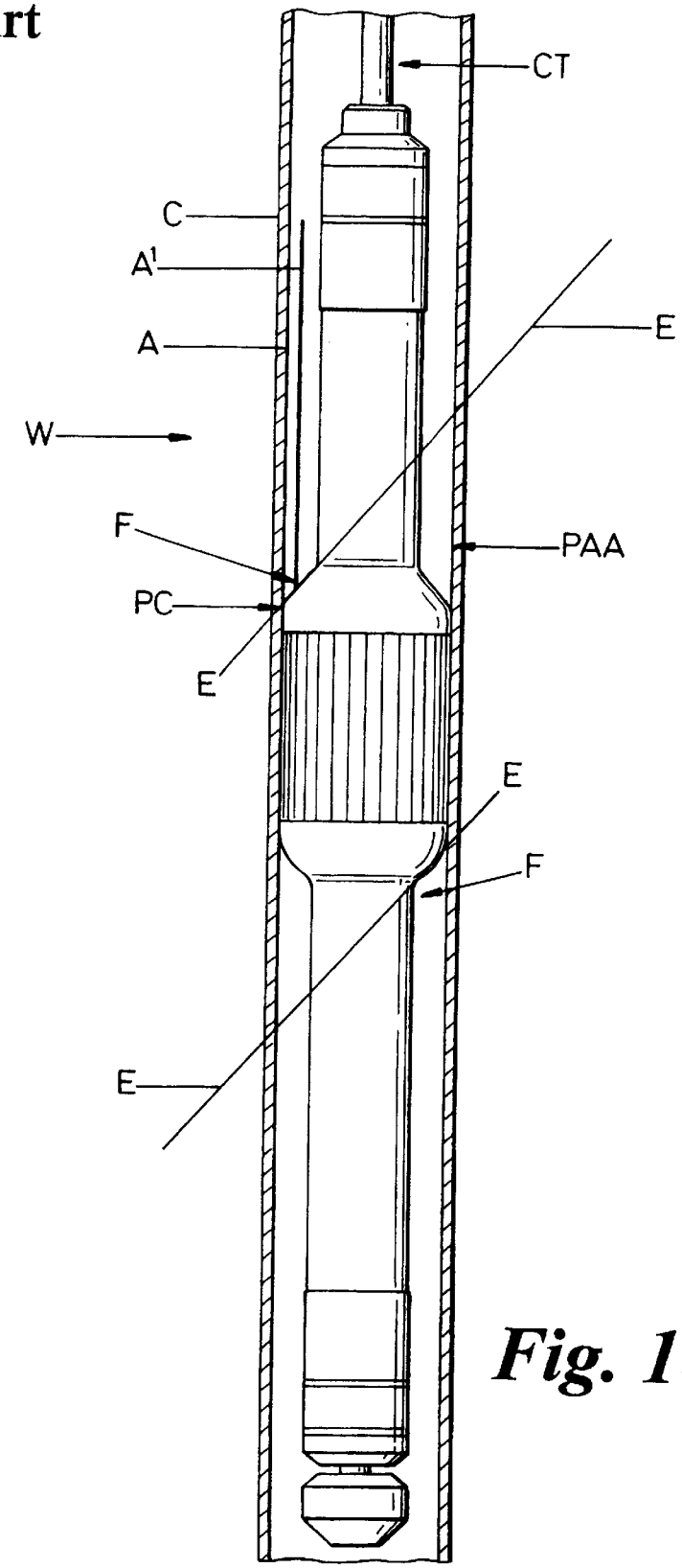
FIG. 18 is a vertical partial cross-sectional schematic illustration of a prior art inflatable packing device being set in a subterranean well with a resultant departure angle well in excess of the maximum angle of the present invention, resulting in sharp angular transitions in the cover along the line of taper defined by the departure angle.

Now, with first reference to FIG. 18, there is shown a prior art apparatus PAA of the inflatable variety partially set within a well W along the interior wall A of a casing conduit C extending to the top of the well (not shown). $A^1$ is a straight line drawn parallel to the longitudinal axis of the wellbore and the inside diameter of the wall W. The apparatus PAA is run in the well W on a conveyance mechanism, such as conduit CT, in conventional fashion.

As schematically illustrated in FIG. 18, the view is taken subsequent to inflation initiation. As shown, each departure angle F is about 40° as determined by measuring the angle between interior wall A and the exterior surface of the device at the point of contact, PC. A line E is drawn from the point of contact PC and tangent to the line of PAA. Departure angle F is defined as the angle between lines A and E.

Figure 1:
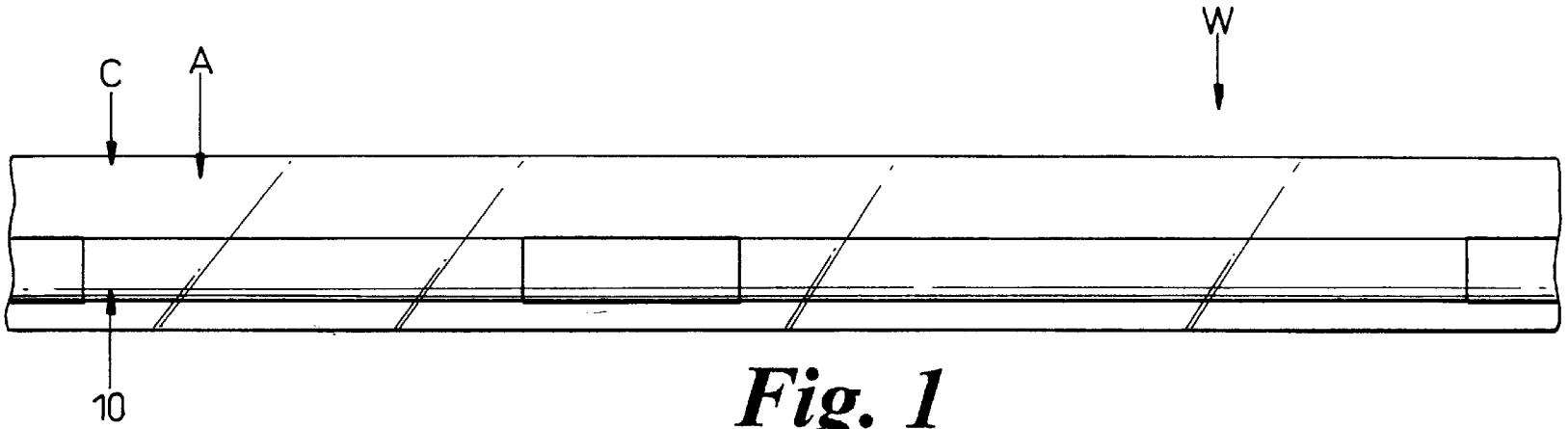
FIGS. 1 through 17 constitute a sequence of computer enhanced photographic views illustrating the inflation cycle of the preferred orchestration for the cover of the apparatus of the present invention in the preferred configuration of FIG. 19, simulating actual down hole setting around the wall of a casing conduit.

Now referring to the photographic illustrations shown in FIGS. 1–17, an apparatus 10 of the present invention is shown disposed within a plexi-glass or other clear conduit section, representing casing C, within a well W. In FIG. 1, the apparatus 10 is viewed in the run-in position just prior to initiation of inflation of the apparatus 10. The casing C has an interior wall A.

Figure 2:
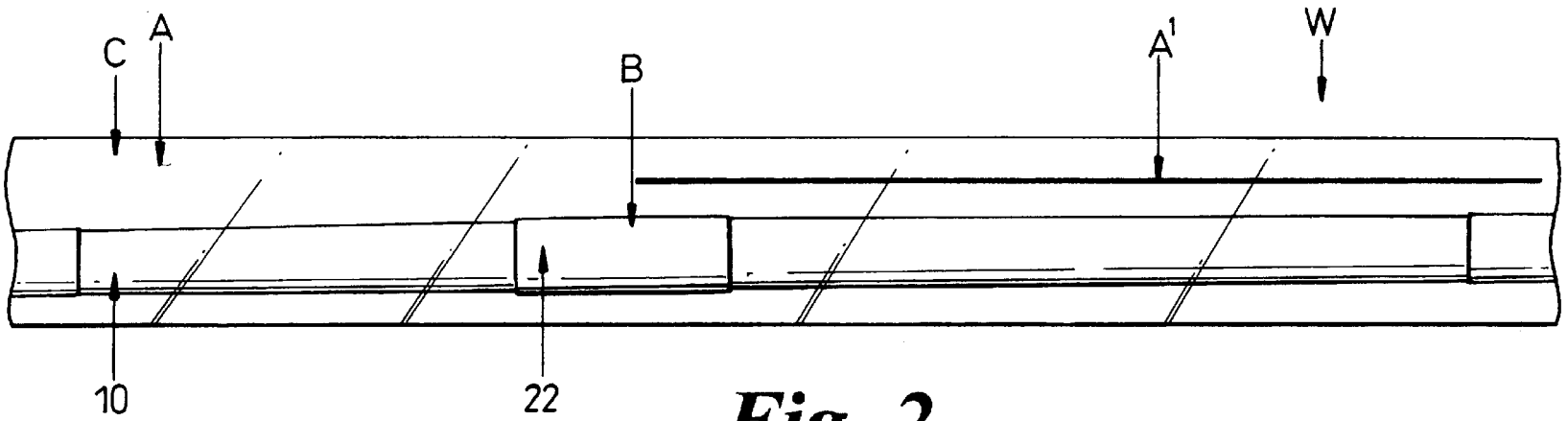

FIG. 2 represents the apparatus 10 at inflation initiation which is visually observant by the outwardly flexing of the circumferentially extending set of metallic ribs or slats 22 which is exposed in this representative design for anchoring engagement along the interior wall A of the casing C. In FIG. 2, the point of inflation initiation is indicated by B with a straight line $A^1$ drawn parallel to the interior wall A being drawn from the inflation initiation point B in one direction of rolling inflation.

Figure 3:
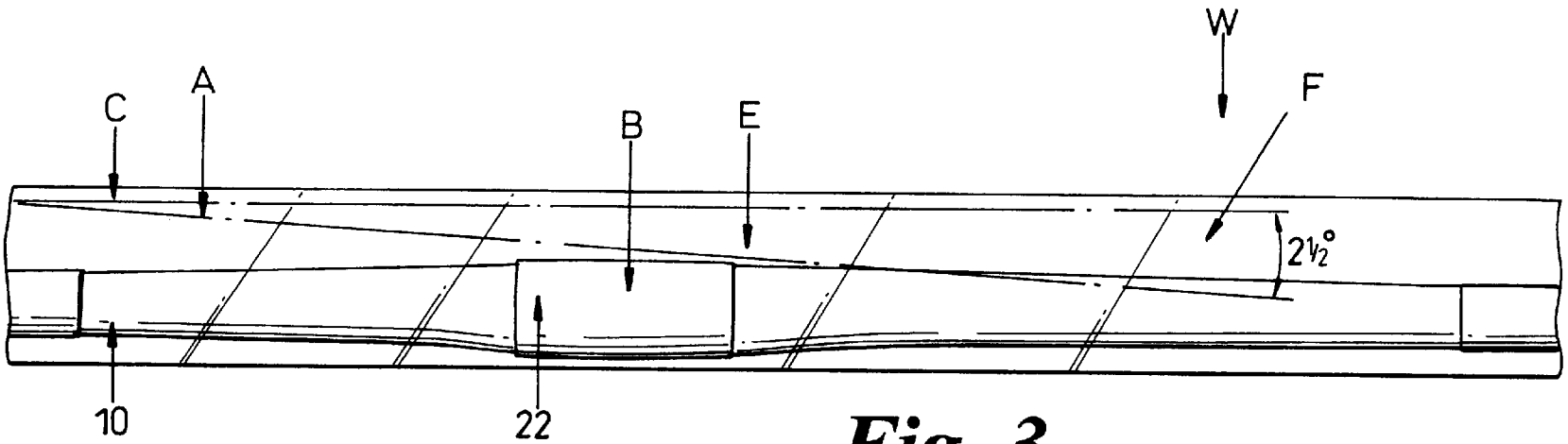

As apparent in FIG. 3, a substantially straight line of taper E is also drawn in the same direction from inflation initiation B resulting in a departure angle of F of about 2½°. In photographic FIG. 3, inflation of the apparatus is continued and the open or exposed ribs or slats 22 continue to flex outwardly towards the interior wall A of the casing C.

Figure 4:
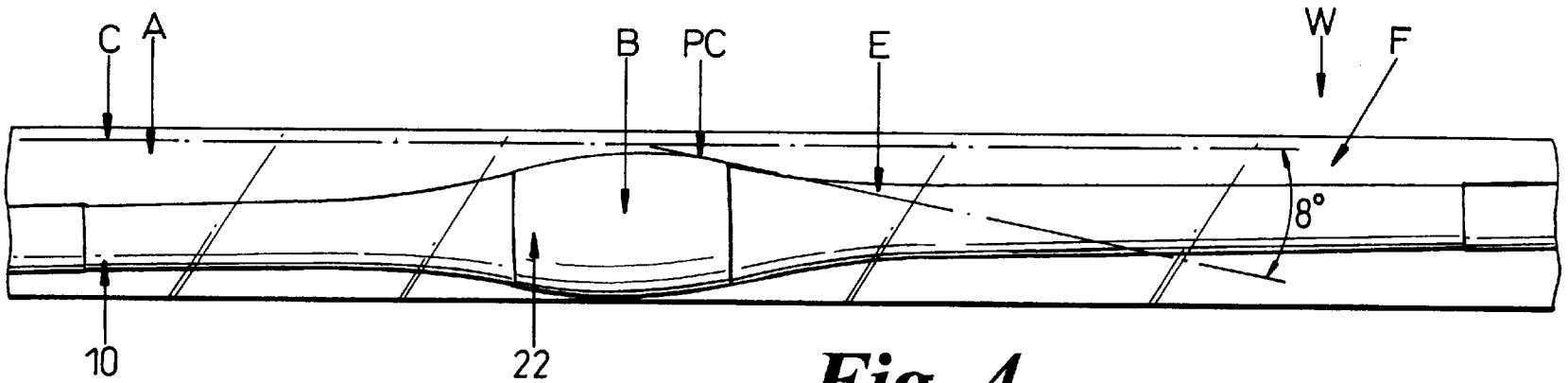

In photographic FIG. 4, the initial point of contact PC has been made with the interior wall A of the casing C and the departure angle F remains at about 8°.

Figure 5:
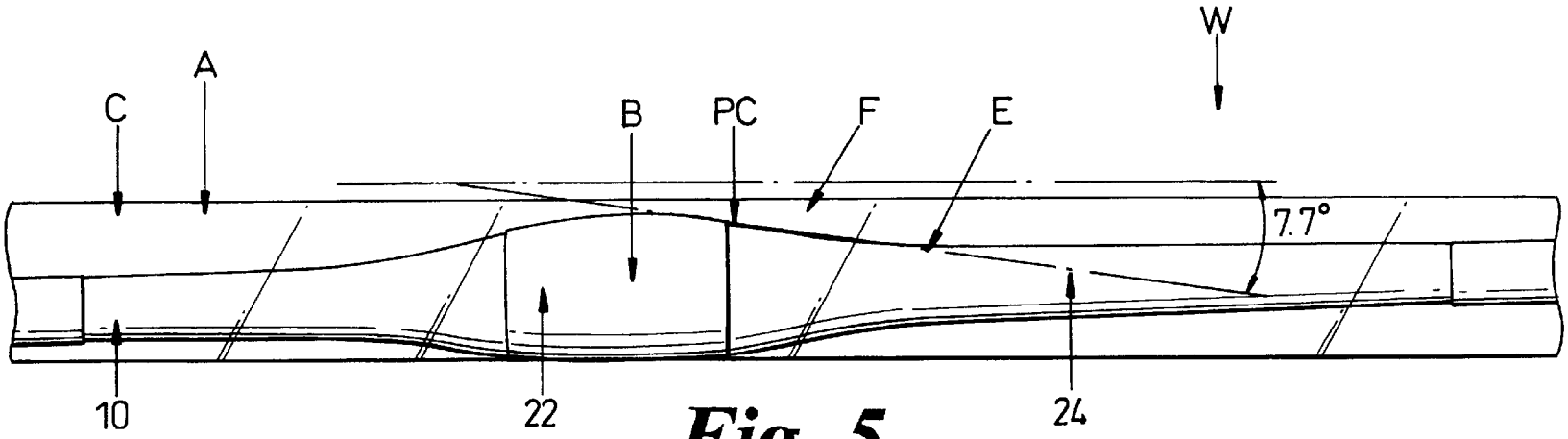
Figure 6:
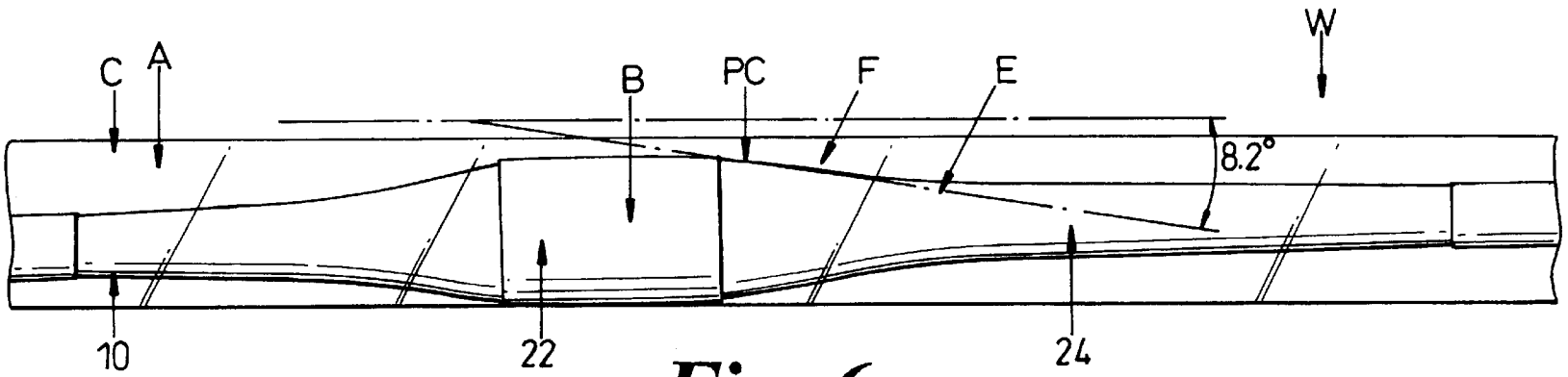

In FIG. 5, the inflation of the bladder has continued to the extent that the point of contact PC now is first defined on the cover 24 as opposed to the metallic slats 22, but the departure angle F continues at approximately 7.7° or less. Fluid between the exterior of the cover 24 and the interior wall A of the casing C would be swept away from the rolling expansion of the cover means as the bladder is inflated.

Figure 7:
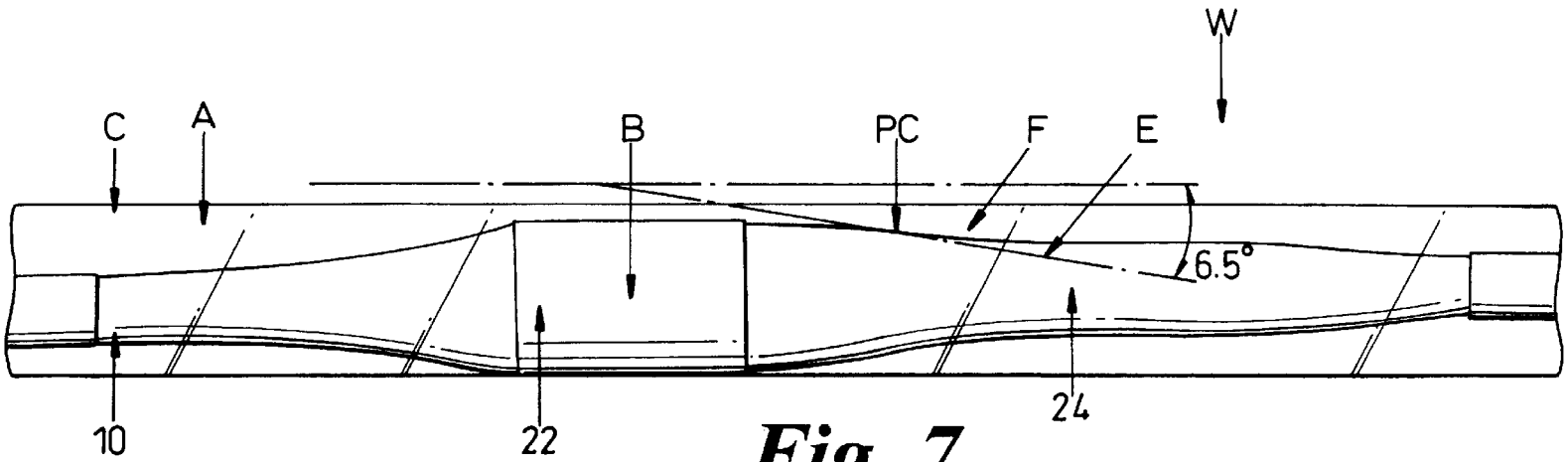
Figure 8:
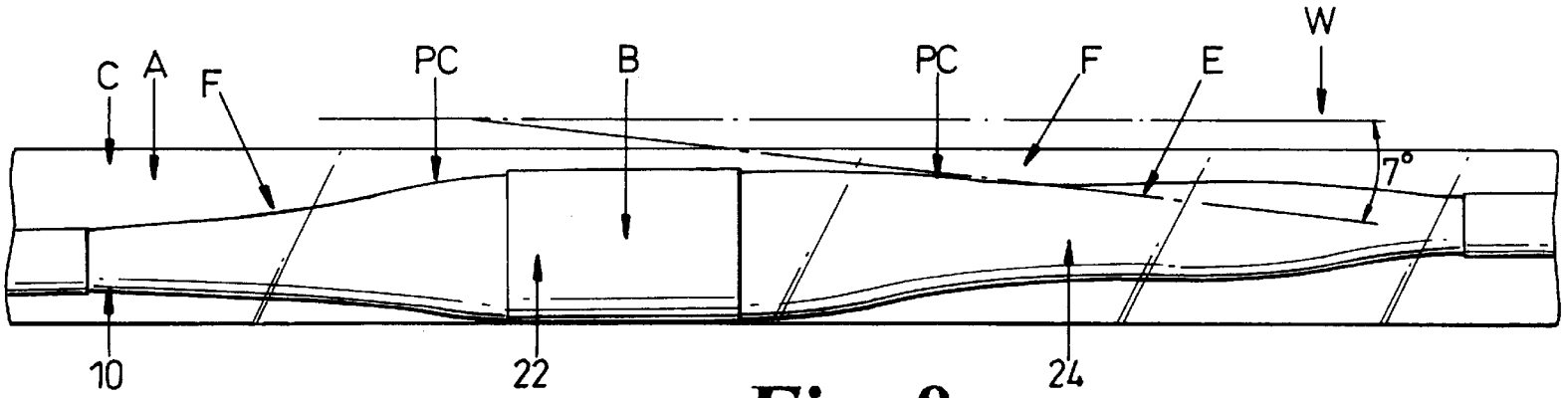
Figure 9:
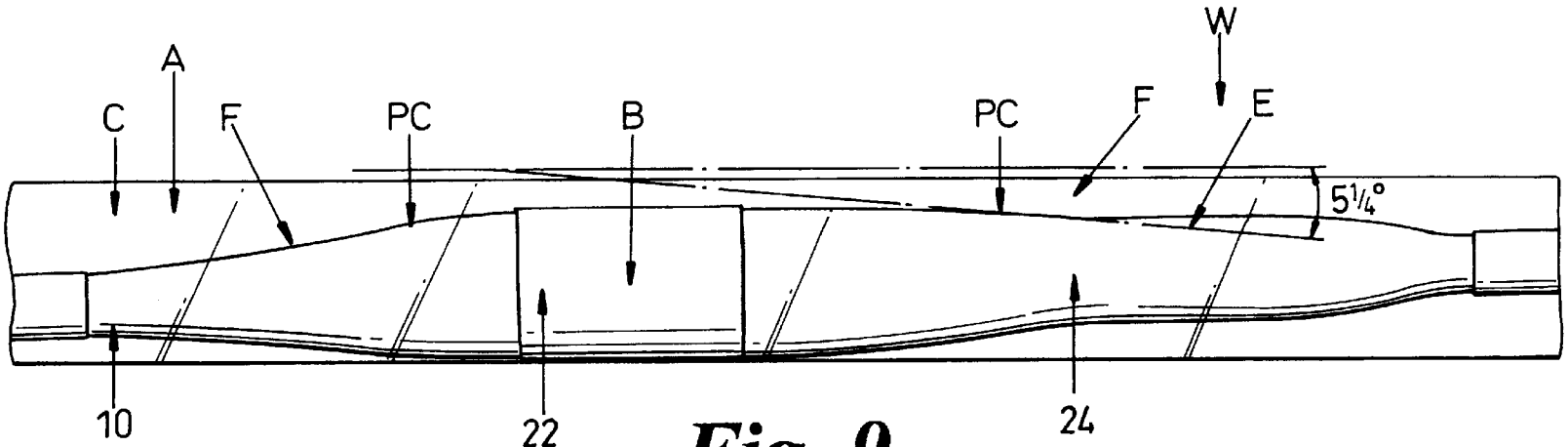

FIG. 8 represents a continuation of the inflation cycle from FIG. 7. In FIG. 9, the rolling effect of the inflation cycle continues and the departure angle F still remains within the acceptable range of no more than about 15°, and was measured to be 5.25°.

In the design of the device 10 shown in photographic FIGS. 1 through 17, upper and lower sections of the cover 24 are shown in sequential inflation views with one of the cover sections being moved to contact with interior surface A somewhat earlier than that of the other cover section. This sequence is contemplated in the invention at hand.

Photographic FIGS. views 5–9 show a continuation of effective inflation with a moving point of contact PC and a continuation of a satisfactory departure angle F of about 5–8°, or less.

Figure 10:
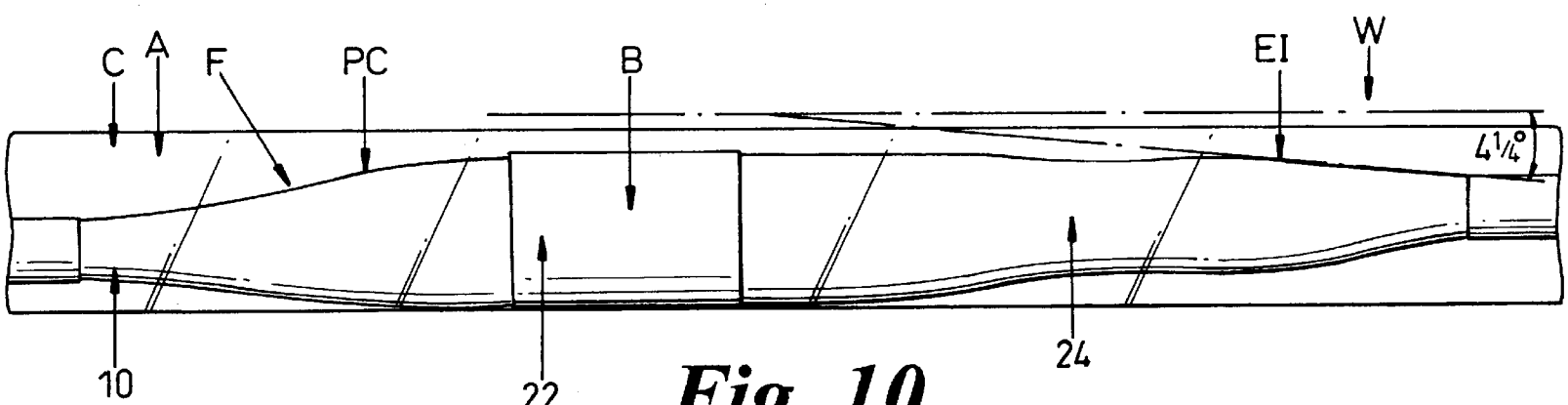
Figure 11:
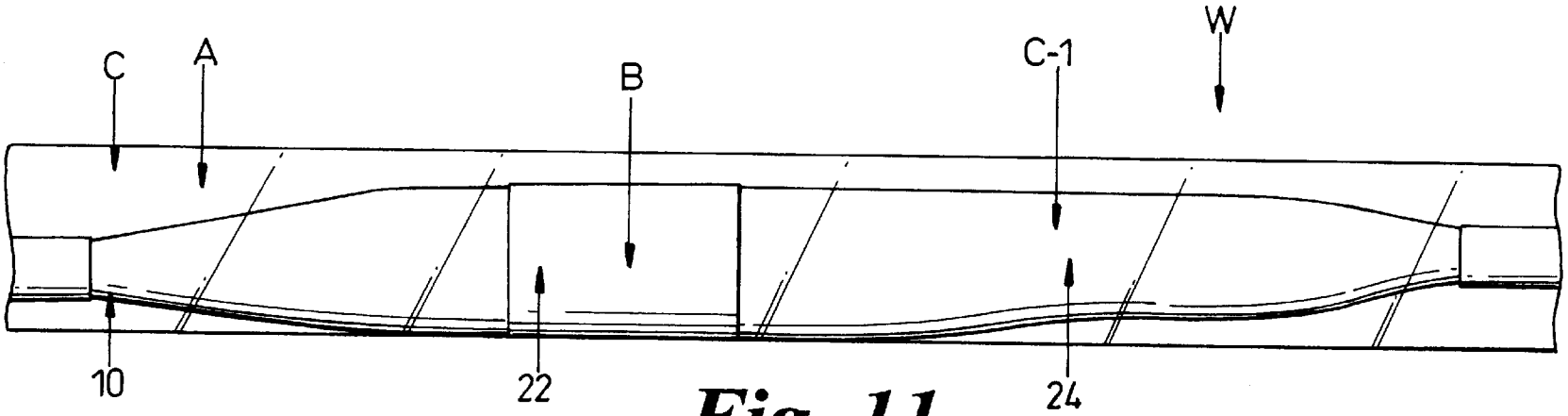
Figure 12:
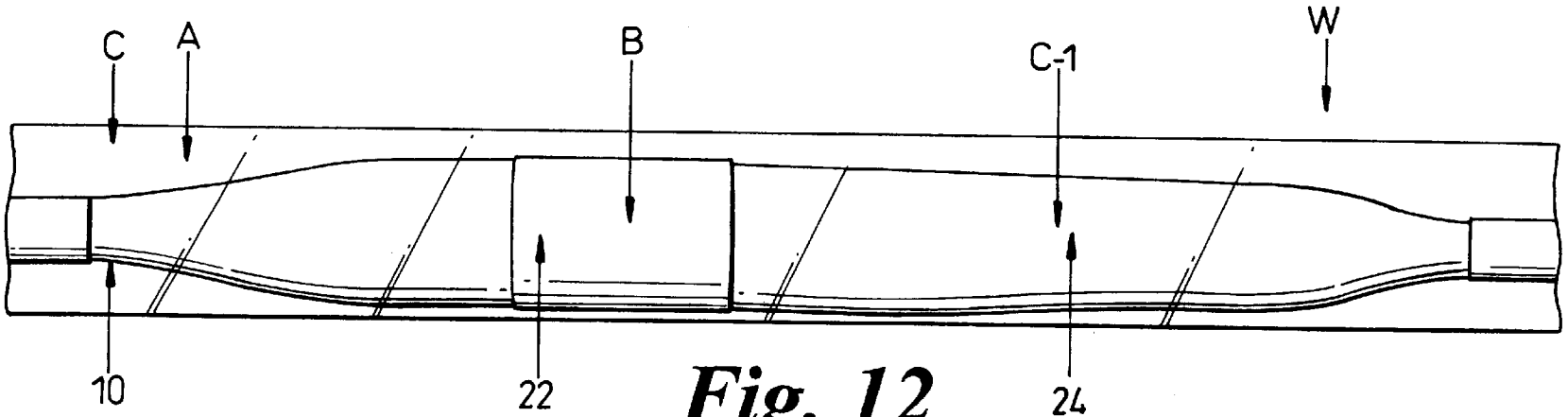
Figure 13:
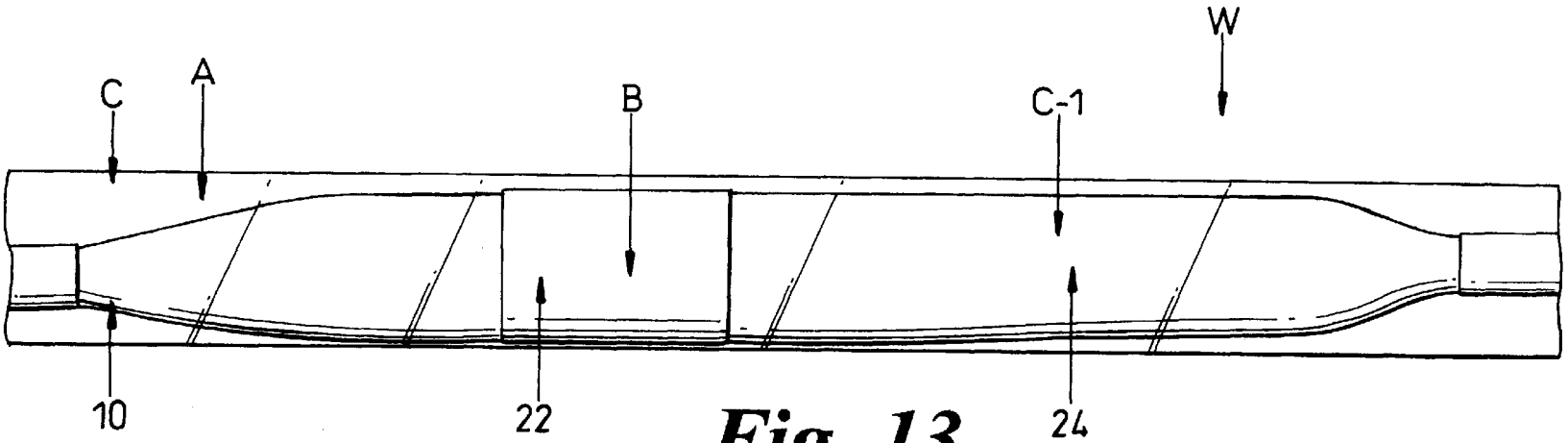
Figure 14:
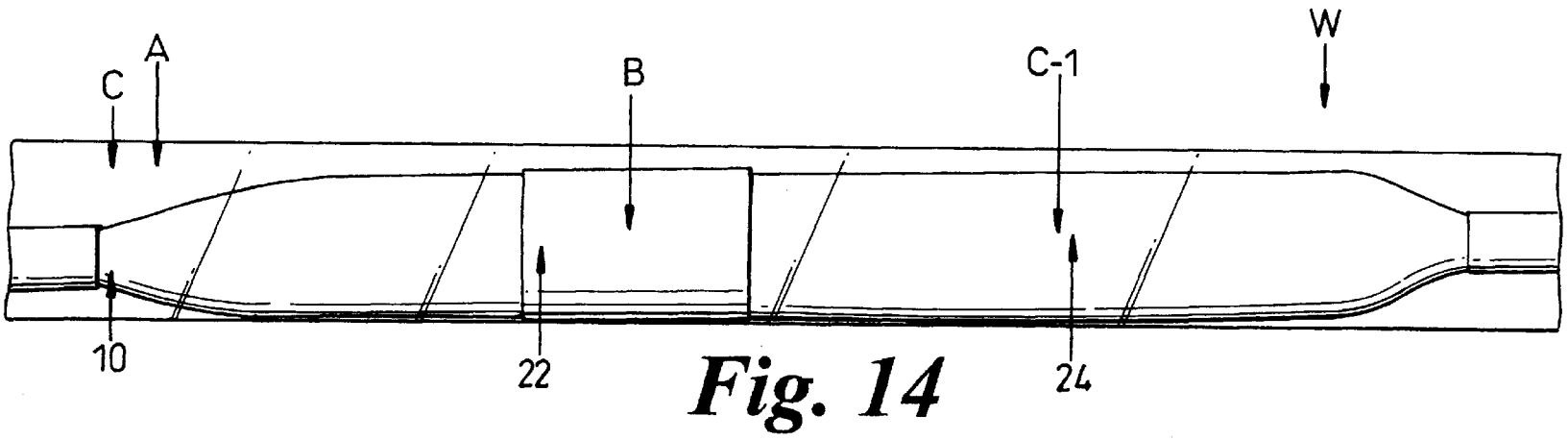
Figure 15:
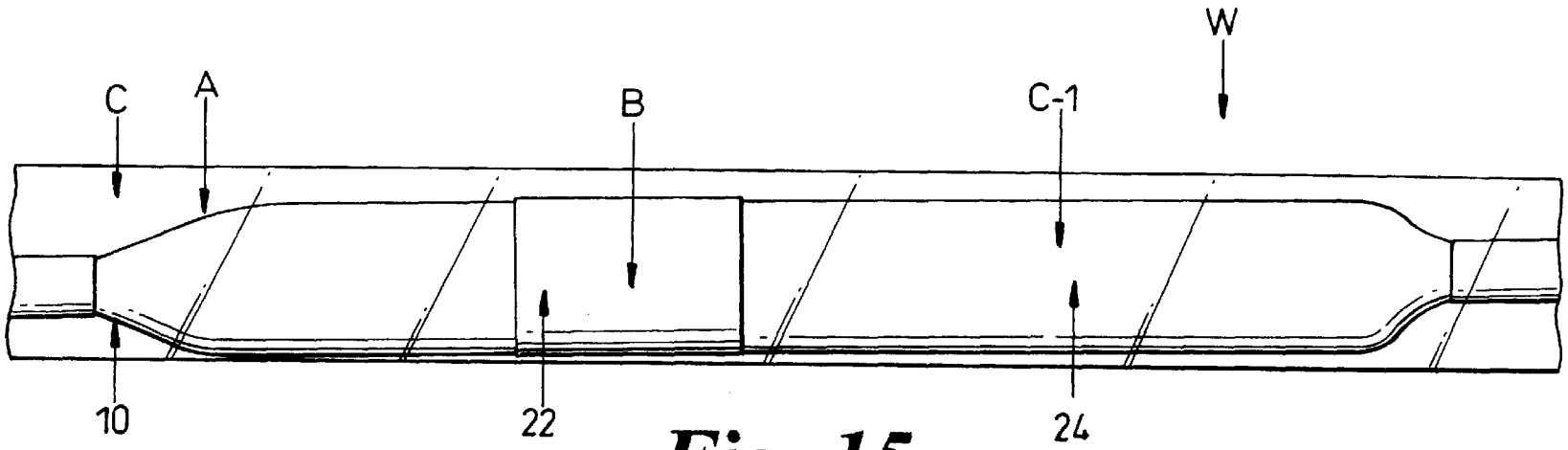
Figure 16:
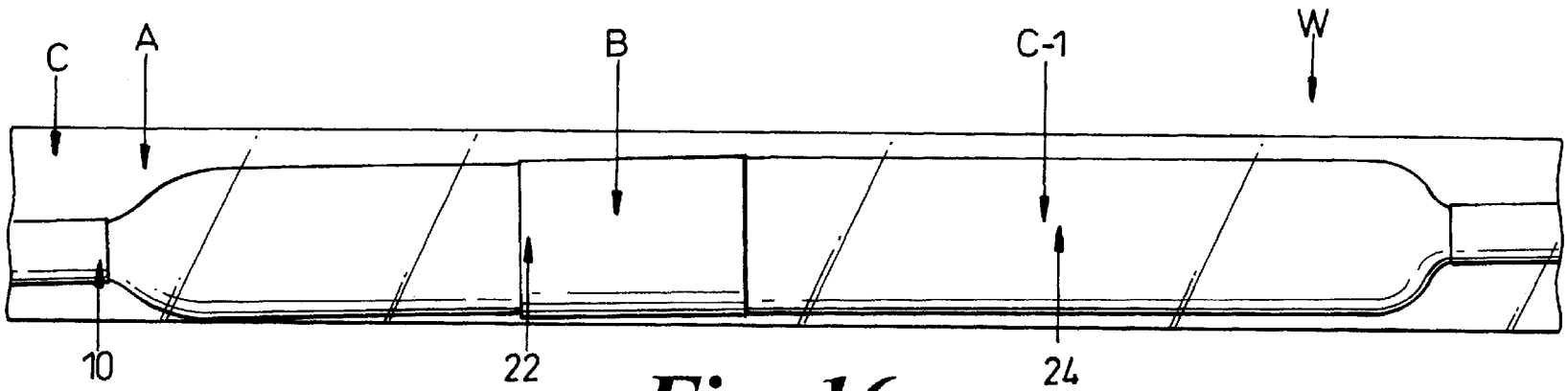

FIG. 10 illustrates basic inflation element profile at the end of effective inflation. Apparatus 10 may be designed such that the cover means continues inflation with departure angles of no more than about 15° at this 2.35:1 expansion ratio, however, because tool inflation has past through effective inflation, it is no longer critical for the inflation profile to approximate the straight line extending from the last point of contact to the collar.

Figure 17:
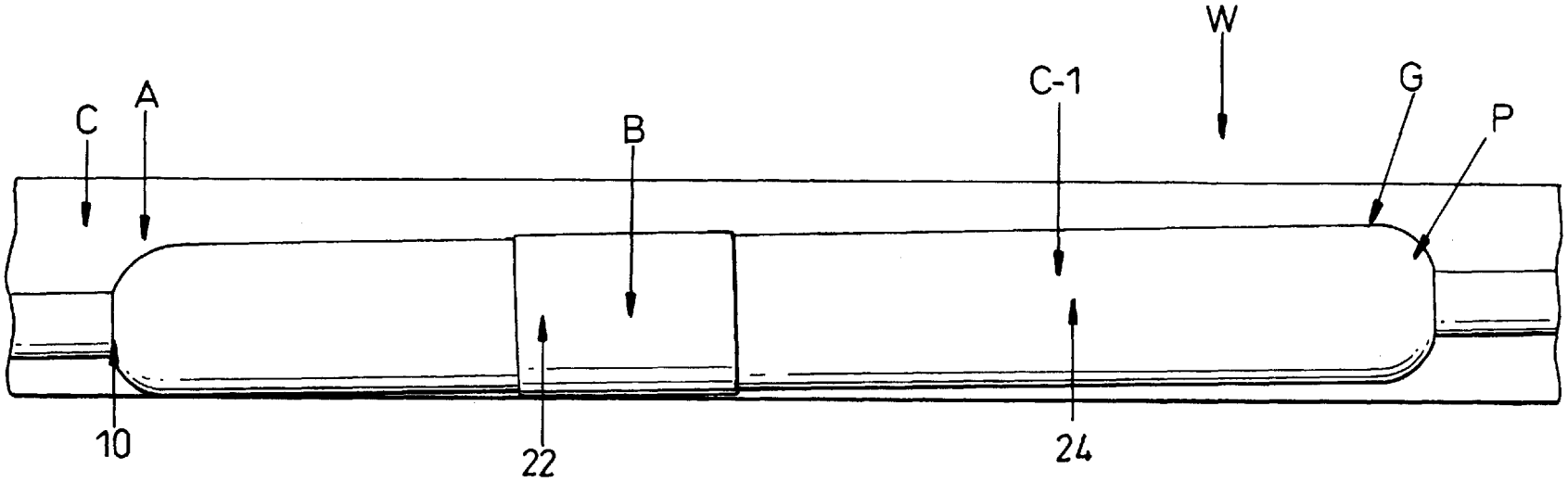

FIG. 17 illustrates photographically the apparatus 10 of the present invention in the complete, set position in the well W.

Photographic FIGS. 11–17 illustrate continued inflation of the device of the present invention subsequent to effective inflation upon and through the upper most section (or left side of view) of cover C-1.

The invention contemplates a device in which the incorporation of a sophisticated contoured cover results in a very low departure angle and uniform expansion profile for the cover throughout effective inflation.

The cover may be manufactured utilizing a number of known procedures. Those skilled in the art of designing and utilizing inflatable packing devices for subterranean wells will be familiar with elastomers which can be utilized as a cover means contemplated by the invention at hand. The exterior profile occurring in the device during inflation is the result of gradual, fine, reductions and contouring of either the exterior or interior of the cover surface, which may be accomplished by conventional machining techniques to reduce the initial diameter of such cover means either upon the outer diameter or the inner diameter, or, in some instances, both, to orchestrate a fine shaping of the inflation profiles taken during effective inflation without apparent, dramatic diameter "steps" resulting in the exterior diametral profile.

In the sequence of photographs of expansion in FIGS. 1 through 17, the smooth, continuous, rolling nature of the uniform expansion profile is apparent. The absence of rib kinking is both obvious and unique for an inflation element having an exposed rib anchor section. Additionally, any well fluids between the exterior of the flexing parts of the device except the extreme ends adjacent the collars and the point of contact PC will be swept away from the point of contact, continuously, as the cover means expands as a result of the uniform inflation of the bladder. This eliminates the possibility of soft set failure of the device.

Figure 19:
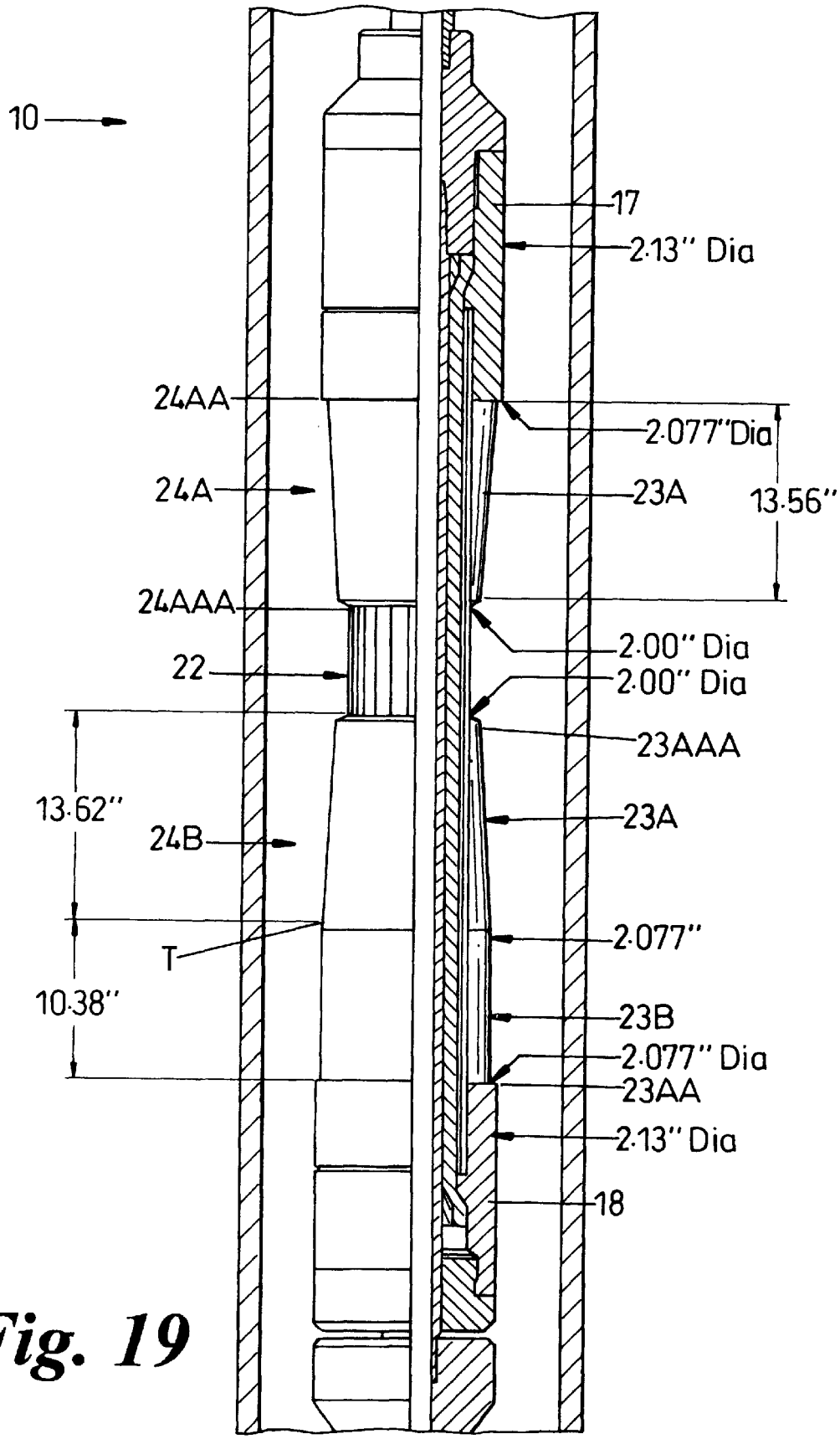
FIG. 19 is an enlarged longitudinally extending view of a device incorporating the present preferred configuration of the cover means in the run-in position in a well, the left half of the drawing depicting the exterior view and the right half of the drawing depicting a cross-sectional view.

Now with reference to FIG. 19, there is shown a preferred configuration of the apparatus 10 of the present invention. In FIG. 19, first and second elastomeric cover sections 24A and 24B bridge exposed ribs or slats 22. The uniform expansion profile of the design of the cover in the device of FIG. 21 for the upper cover means 24A is of a straight line of taper 23A. Likewise, a more elongated cover section 24B is shown as a lowermost cover section of this design which includes a straight line of taper 23A beginning from point T of straight section 23B which extends from the lower collar 18.

The preferred configuration of the invention shown in FIG. 19 is further illustrated by the fact that the length of the upper cover means from the lower most end of the upper collar 17 is 13.56 inches. The outer diameter of the upper collar 17 is 2.13 inches and the outer diameter of the upper most end 24AA of the upper cover means 24A is 2.077 inches, while the outer diameter at the lower most end 24AAA is 2.00 inches. Likewise, the lower most collar 18 has an outer diameter of 2.13 inches and the outer diameter of the lower cover means 23A' at its lower most end 23AA is 2.077 inches. The length of the lower cover means 23A' from the lower most end 23AA to the beginning of the taper T is 10.38 inches and the diameter at such point T is 2.077 inches. The length of the section 24B is 13.62 inches and the outer diameter at the upper most end 23AAA of the lower cover means 23A' is 2.00 inches.

Figure 20:
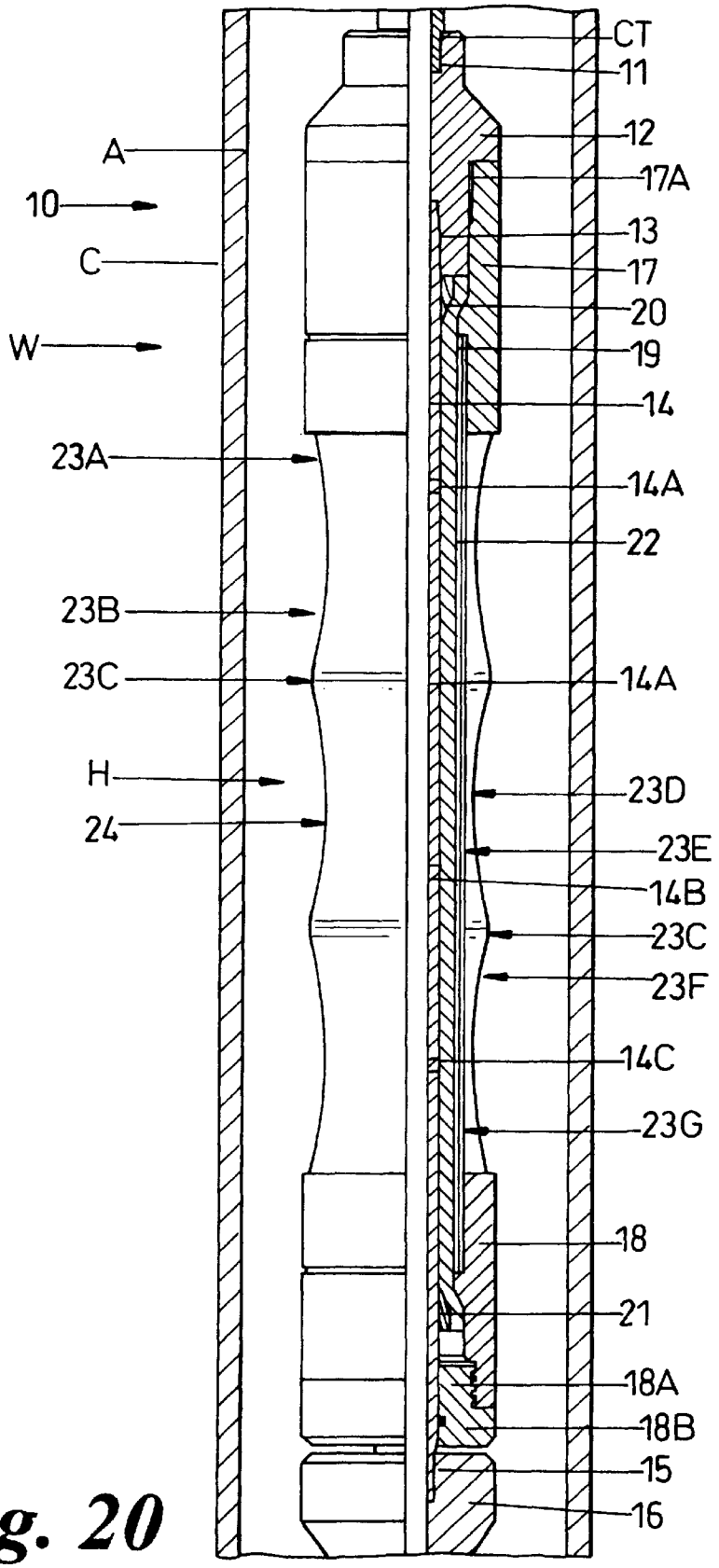
FIG. 20 is a view similar to that of FIG. 19 and illustrating a variation in design of the present invention.

Now referring to FIG. 20, the apparatus 10 is shown with the cover means having an alternate configuration. The apparatus is shown in the run-in position in the well W which has previously been cased with casing C. The apparatus 10 is carried into the well W on a conduit CT which may be production or workover tubing, remedial or coiled tubing, electric wire line, or wire line or any other conduit which is utilized by those skilled in the inflatable packer art to run and set an inflatable packer, bridge-plug or the like, within a well W. The conduit CT may be directly attached to the apparatus 10, such as at threads 11, or may be indirectly secured to the apparatus 10 such as by securement of the conduit CT to a setting mechanism or tool (not shown) which, in turn, is effectively secured or in communication with the apparatus 10.

At each end of the apparatus 10 are a series of upper and lower cylindrical connectors 12 and 16, respectively. The upper connector 12 is secured at threads 13 to a longitudinally extending cylindrical mandrel member 14 having a series of spaced radially extending ports 14A, 14B and 14C disposed therethrough. The lower end of the mandrel is secured at threads 15 to the lower connector 16. The apparatus 10 may be inflated in a number of known fashions using devices or means for delivering pressured fluid through the ports 14A, 14B and 14C to the interior of an inflatable bladder or inflatable element 19 which is secured at each end thereof by upper and lower collars 17 and 18. The upper most portion of collar 17 is secured by threads to the upper connector 12, while the lower collar 18 is secured at threads 18A to a ring member 18B. While the upper collar 17 and upper connector 12 are secured one to another at threads 17A and, in turn, threads 11 securing the connector 12 to the lower most end of the conduit CT, the lower collar 18 and ring 18B are not so permanently engaged relative to the lower connector 16 to thereby permit one end of the apparatus 10 to retract relative to the other end during expansion of the cover 24, in conventional fashion. Retaining rings 20 and 21 secure the upper and lower ends of the inflatable element 19 between the exterior of the mandrel 14 and the interior of inflatable element 19 and between the respective collars 17 and 18.

The housing H includes the connector 12, mandrel 14, connector 16 and collars 17 and 18.

The cover 24 is shown with a series of curved, smooth lines of taper 23A from the top of the apparatus and which is inwardly curved. This line of taper 23A continues, substantially uninterrupted, to an outwardly protruding curved smooth line of taper 23B having radial apex 23C which, in turn, extends to an inwardly extending smooth line of taper 23D which, in turn, and uninterruptedly, extends to an outwardly curved line of taper 23E to another apex 23C. Similar curve lines of taper 23F and 23G extend downwardly from the lower most apex 23C to the lowermost portion of the tool terminating at the top of the lower collar 18.

Figure 21:
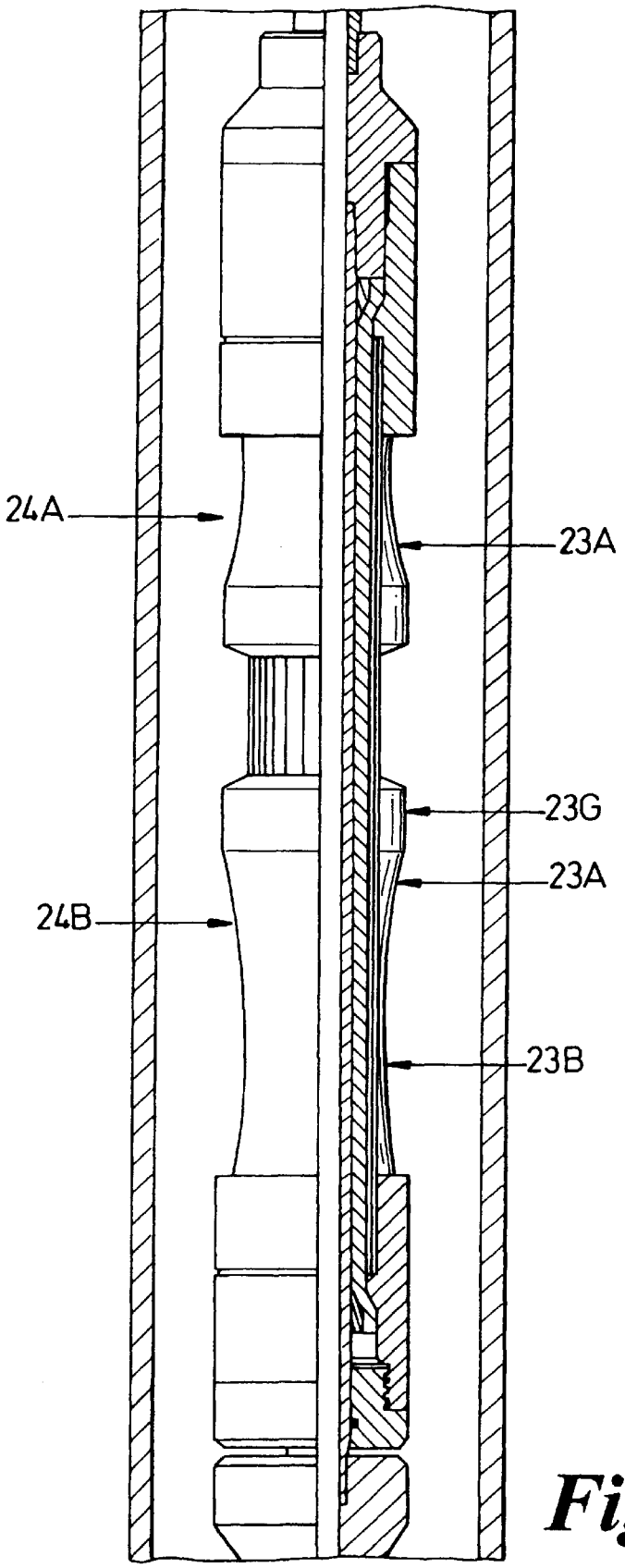
FIG. 21 is a view similar to FIG. 20 illustrating yet another embodiment of the present invention.
Figure 22:
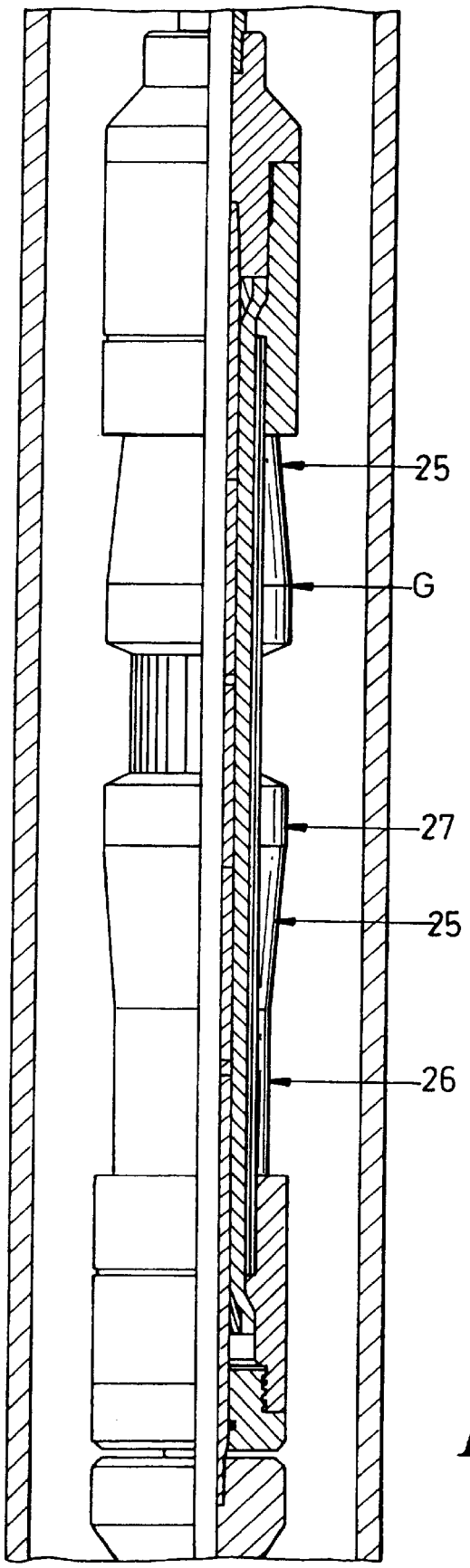
FIG. 22 is a view similar to FIGS. 20 and 21 showing yet another embodiment of the present invention.

In FIG. 21, another configuration of the exterior of the apparatus 10 is illustrated with the departure angle including a substantially curved line of taper 23A as opposed to a straight line of taper illustrated in FIG. 19 or the curved configurations 23A, 23B, 23E, 23F and 23G shown in FIG. 20. Likewise, in FIG. 22, the lowermost portion of the cover means has its uppermost end at the end of effective inflation and has a substantially straight line taper 26 extending upwardly to straight line taper 25 and then to another straight line 27. The upper cover section has straight line taper 25 to effective inflation point G.

It will be appreciated that the angle of departure shown in the design of FIGS. 1–17 will be less than 8°. This, of course, is well within the tolerance of the departure angle of the present invention, i.e., no more than about 20°.

To enhance the programmed effect of the inflation process to abate rib kinking and pinching and the like, as described earlier, a programmed bladder may be incorporated with a cover having the shape-controlling means as described in my U.S. Pat. No. 5,813,459.

It will be appreciated that the present invention provides a contoured cover as a continuous tubular member with a finite length composed of contiguous intervals having varying magnitudes of length and diameter. By varying the combinations of interval diameters and lengths in the cover, as well as varying the juxtaposition of the intervals, desired transitional shapes of the bladder and the inflation element during inflation will be produced.

It will also be appreciated that each interval does not need to be a constant diameter, as the diameter of an interval can vary in a smooth gradual manner to provide, for instance, a sloped profile or a curved profile as opposed to a plateau-type profile. But it is important to note that the present invention avoids profiles that are "stepped," or dramatically varied between one another, as in prior art components and the use of sophisticated profiles can be used to achieve optimal transitional shapes for a wide variety of cover/anchor designs.

It will also be appreciated that the orchestration of the variable diameters and lengths and the spacial location and interaction of the juxtaposed intervals will allow the user to program these parameters to achieve specific desired characteristics and are not just limited to minimizing departure angle. Moreover, deliberate combinations of cover profile features can achieve desired transitional shapes during the inflation cycle.

It will also be appreciated that incorporation of the present invention in a cover for such a packer device results in elimination of rib kinking, rib cutting of the bladder and abrupt changes in the cover thickness and no sealing pinches or convoluted folds occurring during inflation. Moreover, soft sets are eliminated because there is no trapped fluid between the cover and the casing. Improved reliability and service performance for the bladder are achieved as a result of reduced triaxial stresses and strains.

In actuality, excellent uniform expansion profiles do not project perfect straight lines from their contact points through the components of the device, such as end collars, but instead exhibit near straight lines like those in FIGS. 4–17. Those who are experienced in design and testing of inflatable devices would equate the profile lines in FIGS. 4–17 with straight lines.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packing device for use in a subterranean well bore having a wall and carriable into the well bore on a conveyance mechanism, said device being inflatable by pressured fluid communicated to the device from a source of fluid to seal the device against the wall in the bore upon inflation, said device comprising:

(a) a housing;

(b) an means for effective engagement of the housing relative to the conveyance mechanism;

(c) an inflatable bladder carried by said housing; and (d) elastomeric cover means positioned exteriorally of said bladder for sealing against the wall of the well bore, said cover means being programmed to provide a continuously smooth outer surface area extending from a point of contact during effective inflation at a departure angle of no more than about 20° at expansion ratios to about 3:1.

2. The inflatable packing device of claim 1 wherein said cover means provides a uniform expansion profile whereby well fluids are displaced between the wall of the well bore and the exterior of the cover during effective inflation.

3. The inflatable packing device of claim 1 wherein the outer surface area of said cover is continuously smooth so as to prevent pinching or folding of the bladder around the housing during inflation.

4. The inflatable packing device of claim 1 wherein the departure angle is less than about 8°.

5. The inflatable packing device of claim 1 further including: a series of elongate ribs disposed between the bladder and the cover means.

6. The inflatable packing device of claim 5 wherein one or more sections of said ribs are not covered by said cover means, at least one section of said elongated ribs thereby defining means for anchoring said packing device relative to said wall.

7. The packing device of claim 1 wherein said cover means includes upper and lower sections, said sections being separated by a series of exposed elongate rib members radially expandable outwardly as the bladder is inflated for contacting and anchoring engagement relative to said wall.

8. The inflatable packing device of claim 1 wherein the uniform expansion profile of the elastomeric cover means comprises a graduated reduction in the thickness of said cover means between the initial outer diameter and the initial inner diameter thereof during manufacture.

9. The inflatable packing device of claim 1 wherein the uniform expansion profile of the elastomeric cover means comprises a graduated reduction in the thickness of said cover means between the initial outer diameter and the initial inner diameter thereof during manufacture and along substantially the complete length of the cover means.

10. A elastomeric cover for incorporation into an inflatable packing device for use in a subterranean well bore having a wall, said cover including a continuously smooth outer surface area extending from a point of contact during effective inflation at a departure angle of no more than about 20° at expansion ratios to about 3:1.

11. The cover of claim 10 wherein the cover includes a uniform expansion profile programmed along the inner diameter thereof to cause displacement of well fluids between the wall of the well bore and the exterior of the cover effective inflation.

12. The cover of claim 10 wherein the cover is further configured to prevent pinching or folding of said cover within said inflatable packing device during inflation.

13. An inflatable packing device for use in a subterranean well bore having a wall and carriable into the well bore on a conveyance mechanism, said device being inflatable by pressured fluid communicated to the device from a source of fluid to effectively seal the device against the wall in the bore upon inflation, said device comprising:

(a) a housing including a mandrel;

(b) means on said housing for effective engagement of the housing relative to the conveyance mechanism;

(c) an inflatable bladder concentrically disposed around the mandrel; and (d) an elastomeric cover positioned exteriorally of said bladder for sealing against the wall of the well bore, said cover being programmed to provide a continuously smooth outer surface area for the exterior of said cover extending from a point of contact during effective inflation at a departure angle of no more than about 20° at expansion ratios to about 3:1, whereby a uniform expansion profile is provided to displace well fluids between the wall of the well bore and the exterior of the cover during effective inflation and, further, whereby pinching or folding of the bladder around the mandrel is abated during inflation.

14. The inflatable packing device of claim 13 wherein the departure angle is no more than about 8°.

15. The inflatable packing device of claim 13 further including: a series of elongated ribs disposed along the mandrel and between the bladder and the cover.

16. The inflatable packing device of claim 13 wherein one or more sections of said ribs are not covered by said cover, at least one section of said elongated ribs thereby defining means for anchoring said packing device relative to said wall.

17. The packing device of claim 13 including upper and lower sections of said cover, said sections being separated by a series of exposed elongated rib members expandable for contacting and anchoring engagement relative to said wall.

18. The inflatable packing device of claim 13 wherein the uniform expansion profile of the elastomeric cover comprises a plurality of reductions of the initial thickness of said bladder between the initial outer diameter and the initial inner diameter thereof during manufacture.

* * * * *